United States Patent [19]

Rath

[11] Patent Number: 4,605,879

[45] Date of Patent: Aug. 12, 1986

[54] RIGID CRT SHADOW MASK ASSEMBLY

[75] Inventor: Dale R. Rath, Gales Creek, Oreg.

[73] Assignee: Tektronix, Inc., Beaverton, Oreg.

[21] Appl. No.: 650,393

[22] Filed: Sep. 14, 1984

[51] Int. Cl.[4] ..... H01J 29/07

[52] U.S. Cl. ..... 313/407; 313/408; 445/30; 445/37; 445/68

[58] Field of Search ..... 313/402, 407, 408; 445/30, 37, 68

[56] References Cited

U.S. PATENT DOCUMENTS 4,350,922 9/1982 Catanese et al. ..... 313/402

*Primary Examiner*—David K. Moore

*Assistant Examiner*—K. Wieder

*Attorney, Agent, or Firm*—John D. Winkelman; Robert L. Harrington

[57] ABSTRACT

A cathode-ray tube shadow mask mounting system that allows the mask to be removed from the faceplate and replaced in exactly the same position as it occupied before removal includes screw-receiving inserts permanently embedded in the inner surface of the faceplate outside the viewing area of the display screen. Tubular screw guides are secured to the shadow mask frame in corresponding positions, the guides and the inserts having complementary beveled surfaces for drawing them into alignment when a screw is inserted through the guide and threaded into the insert.

7 Claims, 5 Drawing Figures

RIGID CRT SHADOW MASK ASSEMBLY

FIELD OF THE INVENTION

The present invention relates to shadow-mask type color cathode-ray tubes, and more particularly to means for mounting the shadow mask to the faceplate of such a cathode-ray tube (CRT).

BACKGROUND OF THE INVENTION

A shadow mask type color cathode-ray tube conventionally includes a cathodoluminescent display screen comprising a mosaic pattern of phosphor deposits on the inner surface of the CRT's faceplate. The deposits typically are arranged in sets of three, called triads, and have either a round or elongate shape. For convenience, the deposits will be referred to herein as "dots". A plurality of electron guns controlled by an associated scanning system directs a corresponding number of electron beams toward the display screen through a multiapertured shadow mask positioned between the electron guns and the display screen. Each beam's path through the mask is such that it impinges upon and excites only one type of color phosphor material.

The shadow mask consists of a membrane of electron beam absorbing material containing a very closely patterned array of holes of the same shape as the phosphor deposits. These holes are required to be accurately positioned relative to the corresponding groups of phosphor dots on the display screen so as to permit passage only of the particular beam that is intended to address a designated type of phosphor material. Portions of the beam that would fall outside the dot area are intercepted and absorbed by the mask. Accordingly, it is necessary for the shadow mask to be constructed very precisely and positioned very accurately within the CRT.

The mosaic phosphor dot pattern normally is formed by a direct photoprinting process that proceeds substantially as follows: A screen area on the inner surface of the faceplate is first coated with a photosensitive slurry containing phosphor particles of one color. Next, the tube's shadow mask is mounted on the faceplate temporarily and the coating is exposed to ultraviolet light projected through the mask holes from a source located at a position corresponding to that of the related electron gun. The shadow mask is then removed and the coating is treated to remove the unexposed portions, leaving a pattern of dots of the one phosphor color. These steps are then repeated for each remaining color to deposit a group of three phosphor dots—a red, a green and a blue—on the faceplate opposite each mask hole. Of critical importance to this process is the ability to precisely relocate the shadow mask in the same position relative to the faceplate each and every time it is removed. Any variation in the relative placement of the shadow mask and faceplate will cause misplacement of the phosphor dots and color errors in displayed images.

Conventionally, the shadow mask is removably mounted within the CRT by a plurality of spring clip fasteners attached to a frame surrounding and supporting the mask. Before the fasteners are initially secured in place, the shadow mask is properly located relative to the face plate, as by placing a spacer between them. While maintaining this relationship, the clips are engaged with receiving slots in the face plate and then welded to the mask frame. Each clip is thereby precisely located on the shadow mask frame so that it mates with a specific slot the that particular faceplate. The spring clips are yieldable to allow the mask assembly to be removed from the faceplate during tube processing and later replaced in the same position.

Although the use of spring clip fasteners for shadow mask mounting is quite satisfactory and has long been the standard mounting method in entertainment grade color CRTs, it has been found to be unsatisfactory in certain special applications, as where significant levels of vibration are experienced or color accuracy requirements are very high. One example is in CRTs intended for use in avionics applications. The accuracy and readability of in-flight information displayed by such a CRT is essential for safe operation, and any display distortion caused by aircraft vibration must be minimized or eliminated. Because spring clips are inherently susceptible to vibration, and thus may permit relative movement between the shadow mask and display screen, their use is preferably avoided in CRTs designed for use in such applications.

SUMMARY OF THE INVENTION

The present invention is directed to the provision of a shadow mask mounting system that allows the mask to be removed from the faceplate and replaced in exactly the same position that it occupied before removal, thereby preserving its relationship with the faceplate and the phosphor display screen carried by the faceplate. Additionally, the invention provides a mounting system that rigidly locks the components together, thereby preventing relative movement between them and reducing or eliminating susceptibility to vibration.

Very briefly, according to a preferred embodiment of the invention, threaded inserts are embedded in the faceplate of a CRT just outside the viewing area of the display screen. During the initial mask/faceplate assembly process, the shadow mask is disposed in the proper position relative to the faceplate and clamped securely in place. Next, brackets adapted for welding to the shadow mask mounting frame are attached to the inserts with screws, then welded to the frame. After the clamps are removed, the shadow mask can be dismounted from the faceplate simply by removing the screws holding the brackets to the inserts. When the mask and faceplate are reassembled, the mask is precisely relocated relative to the faceplate and the phosphor deposits forming the display screen of the tube.

BRIEF DESCRIPTION OF THE DRAWINGS

The present invention will be more clearly understood by reference to the following detailed description and the accompanying drawings, wherein.

DETAILED DESCRIPTION

Figure 1:
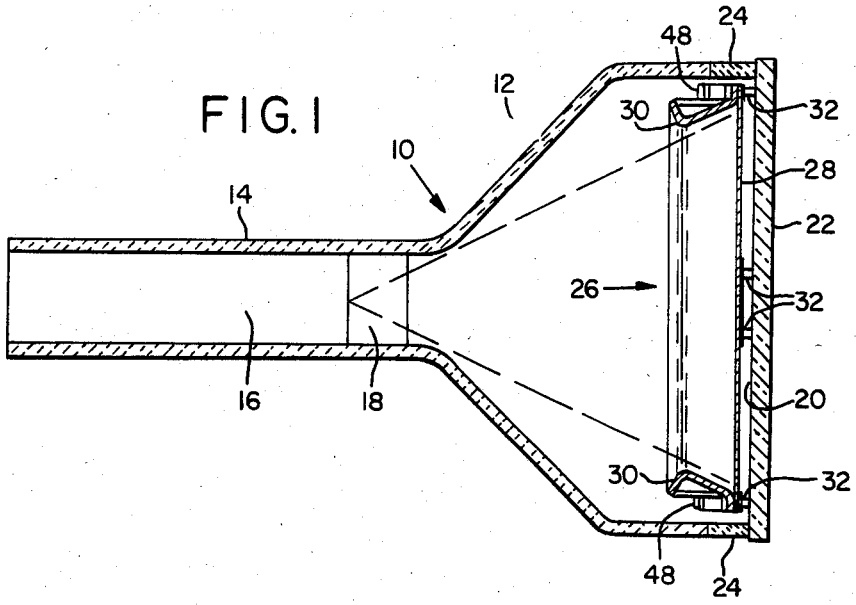
FIG. 1 is a cross sectional side view of a cathode-ray tube incorporating a rigid shadow mask/faceplate assembly in accordance with the present invention.

Referring first to FIG. 1 of the drawing, a shadow mask-type color cathode-ray tube 10 comprises an evacuated envelope 12 having a neck portion 14 housing in region 16 a multiple electron beam source (not shown). This source, which forms no part of the present invention, suitably consists of three electron guns arranged in a triangular or delta configuration around the longitudinal axis of the CRT. An associated scanning system (not shown) including an external magnetic deflection yoke is provided to scan the beams across a display screen 20 on the inner surface of the tube's faceplate 22. Faceplate 22, which suitably is formed of glass, has a peripheral flange 24 that mates with the main body or funnel portion of envelope 12 to form an air tight enclosure. Mounted on the inner surface of faceplate 22 in a manner to be described is a shadow mask assembly 26 comprising a mask membrane 28 secured to a substantially rigid frame 30.

Figure 2:
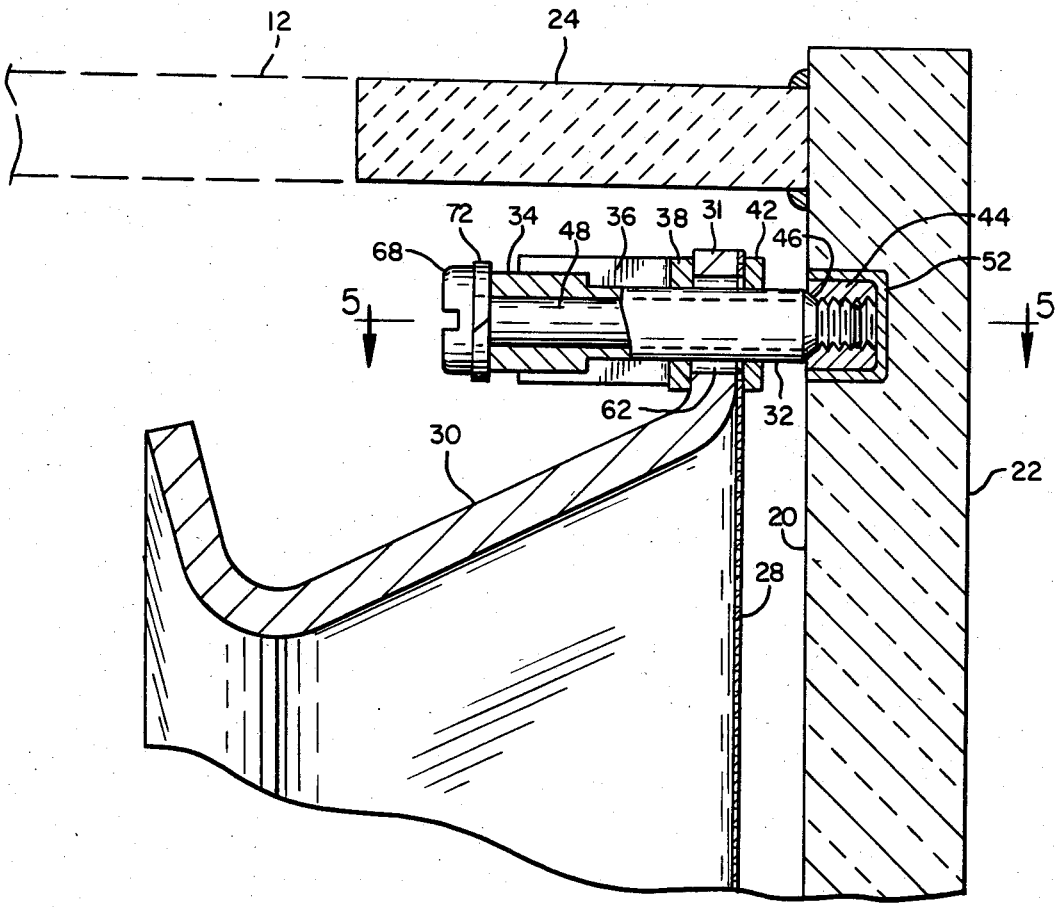
FIG. 2 is an enlarged, fragmentary view of a portion of the FIG. 1 cathode-ray tube illustrating the fastening of the shadow mask to the CRT faceplate.
Figure 5:
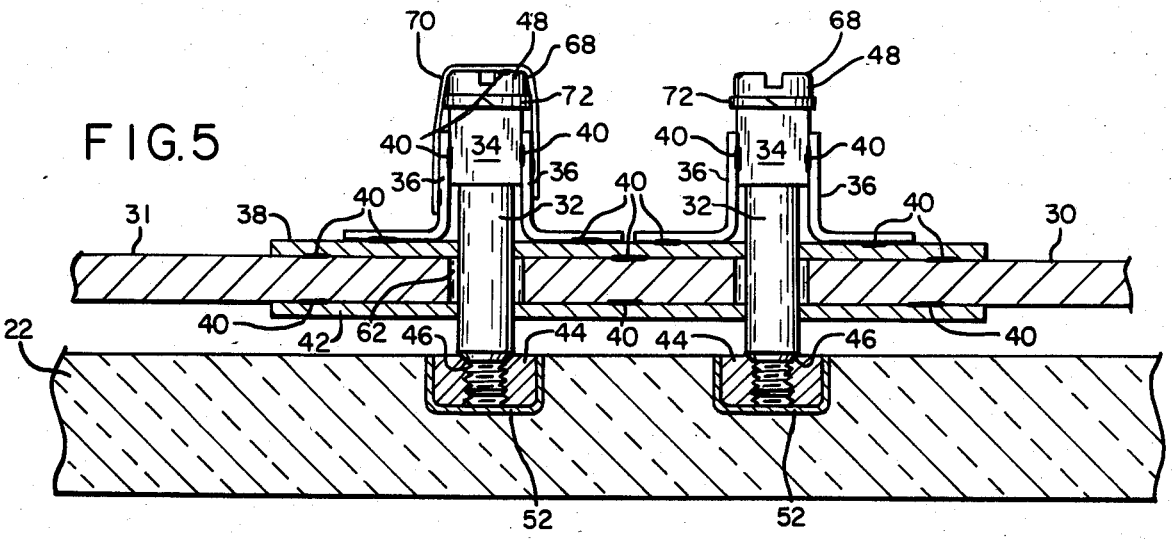
FIG. 5 is a fragmentary view of a completed shadow mask/faceplate assembly as viewed from view line 5—5 of FIG. 2.

Referring now to FIGS. 2 and 5 along with FIG. 1, projecting from a peripheral flange 31 on frame 30 is a plurality of rigid tubular posts 32, each having a rectangular collar portion 34. Two such posts are provided on each of the four sides of the frame. Posts 32 are rigidly fastened to flange 31 by means of L-shaped brackets 36. One leg of each bracket is welded to the side of collar portion 34; the other is welded to a rigid spacer bar 38, which is in turn welded to flange 31. The welds are shown in FIG. 5 by reference numerals 40. The flat sides of rectangular collar portion 34 permit the legs of brackets 36 to be laid flush against the sides of the collars for more secure welding thereof. A second spacer bar 42 is welded to the bottom of frame 30 to maintain posts 32 in precise vertical alignment, as shown in FIG. 5.

A threaded insert 44 is embedded in faceplate 22 opposite each post 32. The open end of each insert 44 is beveled to receive the similarly beveled end of post 32, so that they become axially aligned when the post is seated in the corresponding insert in faceplate 22. The beveled surfaces of both parts (the post and the insert) are indicated by reference numeral 46. Seating of a post in insert 44 is accomplished by inserting a screw 48 through the center of the tubular post to engage the threads of the insert and draw the beveled end of the post into mated engagement with the beveled surface 46 of the insert.

As noted above, the shadow mask assembly must be precisely positioned relative to the faceplate of the CRT when the two are assembled. To accomplish this, according to the present invention one of the mask fastener components—i.e., insert 44—is fixed in place on the rear side of the faceplate while mated with the other component—i.e., post 32. The shadow mask assembly is then placed in the proper position adjacent the faceplate, and the post is secured to the shadow mask frame to preserve the relationship established between the shadow mask and faceplate.

Figure 3:
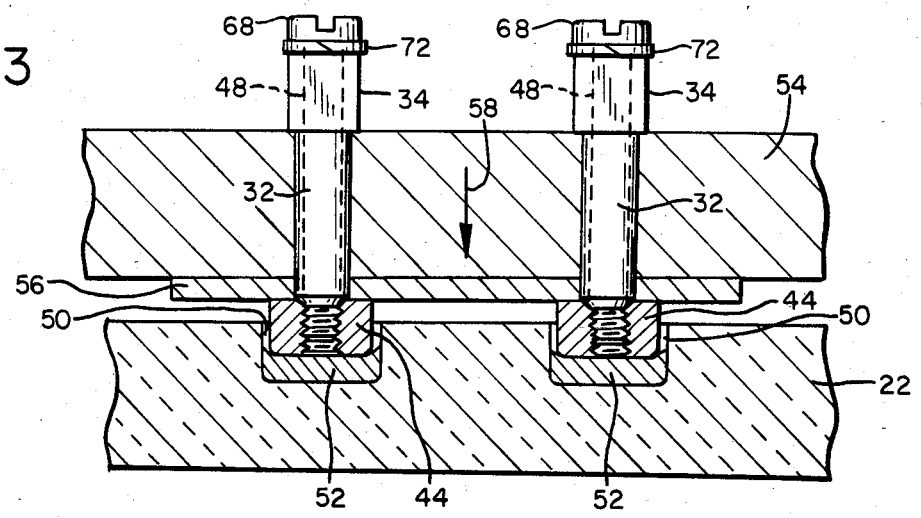
FIG. 3 illustrates the placement of fastener inserts in the faceplate of the FIG. 1 CRT.

Referring now to FIG. 3, which illustrates the process of attaching inserts 44 to faceplate 22, a plurality of cavities 50 are provided on the inner surface of the faceplate at preselected locations outside the viewing area of screen 20 (FIG. 1). The cavities may be formed by etching, grinding, molding or other suitable procedure. Four pairs of such cavities are provided, one pair for each side of the rectangular shadow mask. Although not absolutely required, it is preferable that the locations of the cavities be accurate within ±0.01 inch.

Next, the inserts are precisely positioned within the cavities and fritted in position. The correct positioning is established by threading the inserts onto the protruding portions of screws 48, which are inserted through corresponding posts 32 mounted in a template 54. As will be understood, the posts are set in the template at locations corresponding to the desired placement of the inserts in the faceplate surface. Template 54 is formed of a metal alloy, such as Niron, having a coefficient of thermal expansion similar to that of glass. A shield plate 56 disposed between template 54 and inserts 44 as shown serves to space the template from the glass faceplate during the insert attachment process.

To secure the inserts in place in cavities 50, a predetermimed amount of devitrified glass frit is placed in each cavity. The inserts, mounted in position on template 54, are then inserted into the cavity openings, pressure is applied in the direction of arrow 58, and the entire assembly is heated in a furnace at a temperature sufficient to melt the frit but not soften faceplate 22. After the frit becomes molten, the pressure causes it to flow up and around the inserts, which move into the cavities to a depth determined by the thickness of shield 56. The assembly is then removed from the furnace and allowed to cool, after which screws 68 are removed and the template and shield are separated from the faceplate, leaving the inserts permanently fixed in place.

As will be appreciated, the step of heating the frit does not change the relative spacing of the inserts because the thermal expansion coefficient of the template matches that of the faceplate glass. The shield is made of a material having a significantly different thermal expansion coefficient, however, so that as the assembly cools after removal from the furnace the difference in shrinkage prevents it from adhering to the faceplate.

Figure 4:
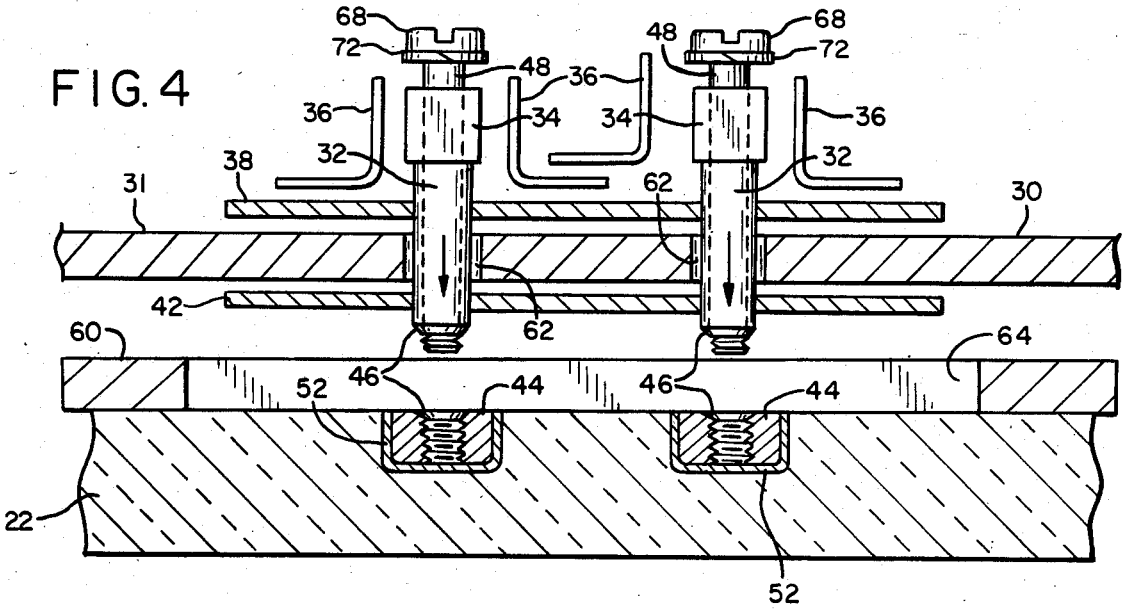
FIG. 4 is an exploded view of the shadow mask fastening components prior to their assembly.

Referring now to FIG. 4, shadow mask frame 30 is provided with openings 62 in flange 31 to accommodate posts 32. The locations of these openings, which are large enough to allow the posts a range of lateral movement, generally coincide with the locations of inserts 44 in faceplate 22. In fastening the posts to the frame at the precise locations desired, a spacer 60 having cut-out regions 64 is first placed on faceplate 22 with the cut-out regions overlying, and thus leaving exposed, inserts 44. An assembly comprising shadow mask frame 30 and multiple sets of first and second spacer plates 38,42 (one set for each pair of inserts) then is disposed atop spacer 60 and posts 32 are inserted through flange openings 62 and mutually aligned openings in the first and second spacer plates, as shown in FIG. 4. Screws 48 provided with lock washers 72 are again inserted into tubular posts 32 and threaded into the respective inserts underlying the posts. After tightening the screws to draw the posts into secure engagement with the respective inserts (and with the shadow mask assembly held in position with clamps or other suitable means), spacer plates 38 and 42 are welded to flange 31. L-shaped brackets 36 then are positioned on opposite sides of posts and welded both to post collar 34 and to spacer plate 38 as shown in FIG. 5. After all of the posts have been attached to the mask, the screws are removed and the shadow mask is lifted off the faceplate. The mosaic phosphor dot pattern then is applied to the screen surface as described earlier. Because the threaded inserts are permanently fixed in position in the faceplate, and the mating guide posts 32 are likewise fixed to the shadow mask frame, each time the mask assembly is reattached to the faceplate it will be relocated in exactly the same relative position. This ensures that the different sets of color phosphor dots will be deposited accurately, substantially eliminating color errors arising from misplacement of the dots.

After the screen has been formed on the inner surface of the faceplate, the shadow mask is attached for the final time. It is desirable, particularly if the finished tube will be subjected to significant vibration during testing or use,. to lock the screws in position by welding a strap 70 to the screw heads and brackets as shown in FIG. 5.

As will be understood, the shadow mask mounting means and method described above exemplify the presently preferred embodiment of the invention. Various alternatives and modifications are possible and are intended to be included within the scope of the appended claims.

I claim as my invention:

1. A shadow mask/faceplate assembly for a color cathode ray tube, comprising a faceplate having inner and outer major surfaces, a shadow mask frame carrying a mask membrane, first fastener means fixedly secured to said faceplate at plural locations within the periphery of the inner surface of said faceplate, and second fastener means in removable, threaded engagement with said first means and secured at corresponding plural locations to said shadow mask frame to rigidly lock said shadow mask/faceplate assembly to reduce vibration.

2. The assembly of claim 1, wherein said first and second fastener means include complementary mating surfaces configured for mutual alignment of said means upon their threaded engagement.

3. The assembly of claim 1, wherein said first fastener means comprises a threaded body inset in said inner surface.

4. The assembly of claim 1, wherein said second fastener means comprises a tubular guide attached to said frame and a threaded body disposed within said guide.

5. The assembly of claim 1 wherein said first fastener means comprises an internally-threaded body inset in said inner surface and said second fastener means comprises an externally-threaded body removably carried by a tubular guide attached to said frame.

6. The assembly of claim 5, wherein said internally-threaded body and said tubular guide include complementary mating surfaces configured for mutual alignment upon engagement of said bodies.

7. A method of removably fastening a shadow mask assembly to a cathode-ray tube faceplate, comprising the steps of providing a shadow mask mounting frame having a plurality of openings at different locations about the periphery thereof, embedding screw-receiving inserts in said faceplate at locations corresponding to the locations of the openings in the shadow mask frame, positioning the shadow mask frame on the faceplate with the openings in the frame in alignment with the corresponding faceplate inserts, disposing screw guides in the frame openings, and inserting screws through the guides and into threaded engagement with the corresponding inserts, and while thus positioned, securing the screw guides to the shadow mask frame.

* * * * *